United States Patent [19]

Murai et al.

[11] Patent Number: 4,611,188

[45] Date of Patent: Sep. 9, 1986

[54] CIRCUIT BREAKER

[75] Inventors: Wasaburo Murai, Osaka; Takeshi Yura, Habikino, both of Japan

[73] Assignee: Terasaki Denki Sangyo Kabushiki Kaisha, Osaka, Japan

[21] Appl. No.: 707,687

[22] Filed: Mar. 4, 1985

[30] Foreign Application Priority Data

Mar. 9, 1984 [JP] Japan ..... 59-43860

[51] Int. Cl.[4] ..... H01H 83/00

[52] U.S. Cl. ..... 335/16

[58] Field of Search ..... 335/6, 16, 38, 41, 174

[56] References Cited

U.S. PATENT DOCUMENTS 3,469,216 9/1969 Shiraishi ..... 335/16

4,470,028 9/1984 Vayre et al. ..... 335/16

*Primary Examiner*—L. T. Hix

*Assistant Examiner*—Brian W. Brown

[57] ABSTRACT

It is the main object of this invention to provide a circuit breaker in which the movable contacts have sufficient opening force and opening distance, and in which the breaking time is short. In order to attain the object, the circuit breaker of this invention is provided with a dead center link mechanism comprising a movable contact link which is rotatably supported by the arms of a cross bar which is operated so as to be capable of opening-closing the circuit and tripping by means of a trip-free mechanism, and a toggle spring which is bridged between the cross bar and the movable contact link. When a large current such as a short-circuit current flows, a movable steel plate attracted by an electromagnet for instantaneously tripping hits a rod for supporting the movable contacts which is connected to the movable contact link, whereby the dead center link mechanism makes the movable contacts open at high speed from the fixed contacts. As a result of such an operation, the current-limiting effect in this circuit breaker is excellent and breaking performance is improved.

6 Claims, 11 Drawing Figures

CIRCUIT BREAKER

BACKGROUND OF THE INVENTION

The present invention relates to circuit breakers, more particularly to circuit breakers for promoting current-limiting effect and improved breaking performance.

Generally, in some conventional circuit breakers, electromagnetic means are adapted to operate a trip-free mechanism by the working of the electromagnet for momentary tripping at first, and then to forcibly open a contact arm with the remaining stroke of the electromagnet. However, in such circuit breakers, the movable contact is normally biased by a pressure means such as a compression spring in which the rate of increase of force is normally remarkably high, when the contact arm is forced to open. Therefore the opening force is not enough and it is impossible to get sufficient distance by the action of the electromagnet alone. Accordingly, after some time delay by an operation of switching mechanism, the circuit breaker effectively begin to open the contact with the co-operatio of the trip-free mechanism and the forcibly operating electromagnet means.

But a problem exist in that the breaking time tend to become longer.

SUMMARY OF THE INVENTION

Accordingly, in order to avoid the above-noted problem in the prior art, it is the general purpose of the present invention to provide a circuit breaker in which the action of an electromagnet acts on a movable contact device having a dead center link type spring mechanism to get a sufficient opening distance overcoming the return force of the contacting spring. This invention is the first that can overcome the difficulties inherent in applying the conventional arrangement in a breaking mechanism having two breaking points in series.

Other objects of the present invention are:

1. The provision of a circuit breaker for stongly exhibiting a current-limiting effect when breaking a short-circuit current, whereby thermal or mechanical damage to its system can be reduced and breaking performance can be satisfied with a relatively small arc extinguish chamber.

2. The provision of a circuit breaker in which the force of an electromagnet means for actuating the movable contact in addition to the electromagnetic force between conductors is produced by a short-circuit current in the earliest period of a short-circuit to directly open a set of movable contacts, whereby the initial current-limiting effect is increased.

3. The provision of a circuit breaker for obtaining a stable initial opening action and a stable opening state.

4. The provision of a circuit breaker which is of simple structure and, at the same time, can easily increase the initial arc voltage.

5. The provision of a circuit breaker which can obtain a large opening distance with the co-operation of the electromagnetic repulsive force between the fixed and movable contacts and the electromagnetic means.

6. The provision of a circuit breaker which can positively operate even with small short-circuit currents which contact sufficiently open the movable contact in the prior art.

7. The provision of a circuit breaker which automatically returns a movable contact link and a toggle spring from a short-circuit breaking state to the normal OFF-state when the short-circuit is cleared, whereby the following closing action may be carried out without any hindrance.

8. The provision of a circuit breaker in which not only the ratio of to instantaneous trip setting to each of various rated current is constant, but also the movable contacts can be opened by a lower current for a smaller rated current. Thus a greater current limiting effect is attained with this action and by the inner resistance of a winding coil which is larger for a smaller rated current.

9. The provision of a circuit breaker in which the electromagnetic attracting force is assisted by the action for attracting a movable contact link, whereby ferromagnetic members are used, produced by the short circuit current which is flowing through the fixed contact conductor.

10. The provision of a circuit breaker in which an arc is easily lead into an arc extinguish chamber to raise the arc extinguishing effect by the action of flux of the electromagnetic means.

11. The provision of a circuit breaker which can increase the electromagnetic repulsive force for directly acting on a movable contact arm by the short-circuit current flowing through the electromagnetic coil.

One of means for attaining the above objects is that the circuit breaker of the present invention has two breaking points in series for each phase.

Other objects and advantages of the present invention will become apparent from the following description of embodiments with reference to the accompanying drawings.

BRIEF DESCRIPTION OF THE DRAWINGS

The invention is illustrated diagrammatically in the following drawings wherein.

DESCRIPTION OF THE PREFERRED EMBODIMENT

Figure 1:
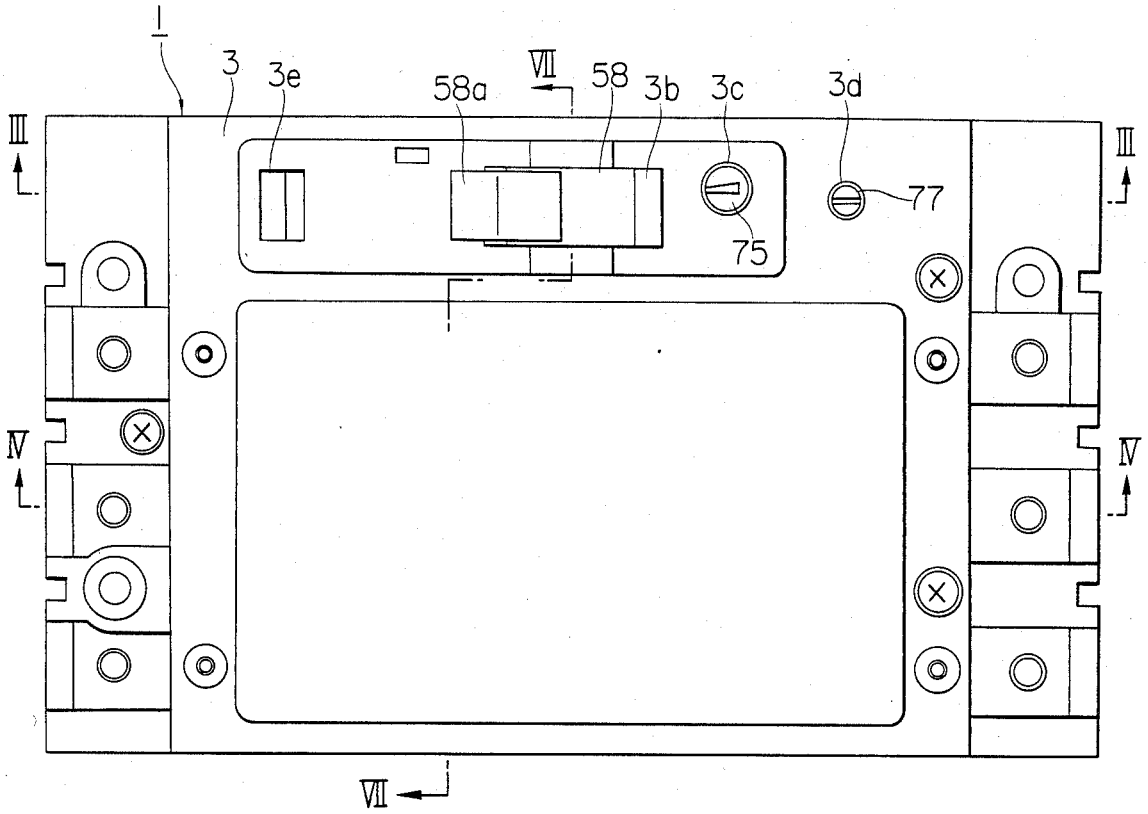
FIG. 1 is a plan view of a circuit breaker of the three-pole type embodying the invention.
Figure 2:
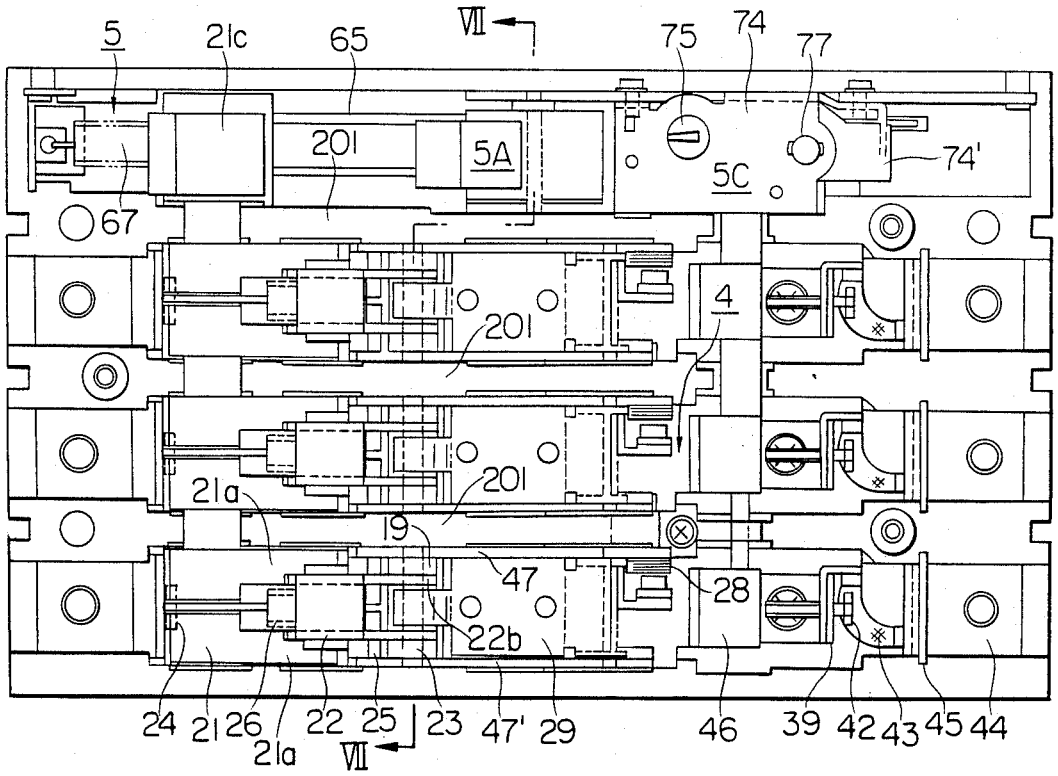
FIG. 2 is a plan view of the circuit breaker of FIG. 1 in which a mold cover is removed.
Figure 7:
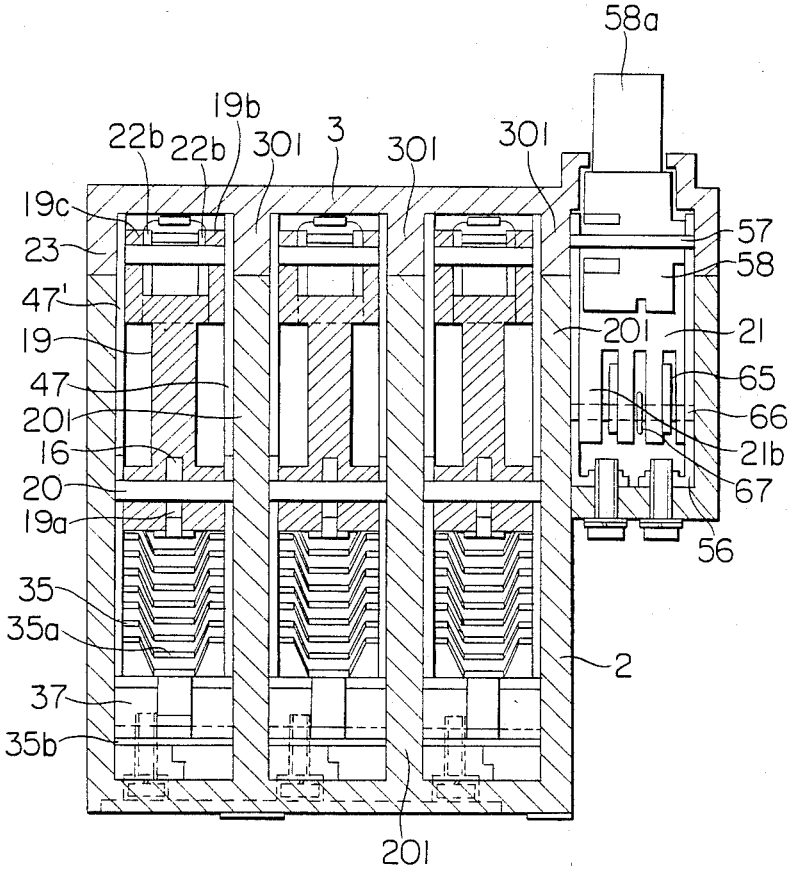
FIG. 7 is a sectional view taken along the line VII—VII of FIGS. 1 and 2.

Referring to FIGS. 1 to 4 in which a circuit breaker constructed in accordance with the present invention is illustrated, the circuit breaker has a breaker body 1 which is formed into a box shape from a mold base 2 made of an insulator, a base cover 2' being a part of the mold base 2, and a mold cover 3, and the breaker body 1 covering all of the live parts in the circuit breaker except the terminal portions. The mold base 2 and the mold cover 3 have comb-like insulating partition walls 201 and 301 as shown in FIGS. 2 and 7. In joining the mold base 2 and the mold cover 3, each tunnel-like pole chamber 4 in which the main constitutional means of each pole and operating mechanism part are accommodated is formed, and in which a switch operating mechanism chamber 5 being adjacent to the one side of the pole chamber 4 is formed. In the operating mechanism chamber 5 a switch operating mechanism 5A, a trip mechanism 5B and a rated current adjusting mechanism 5C are accommodated.

For purposes of simplification and illustration, common parts to all poles will be described in regard to only one of the poles.

Figure 4:
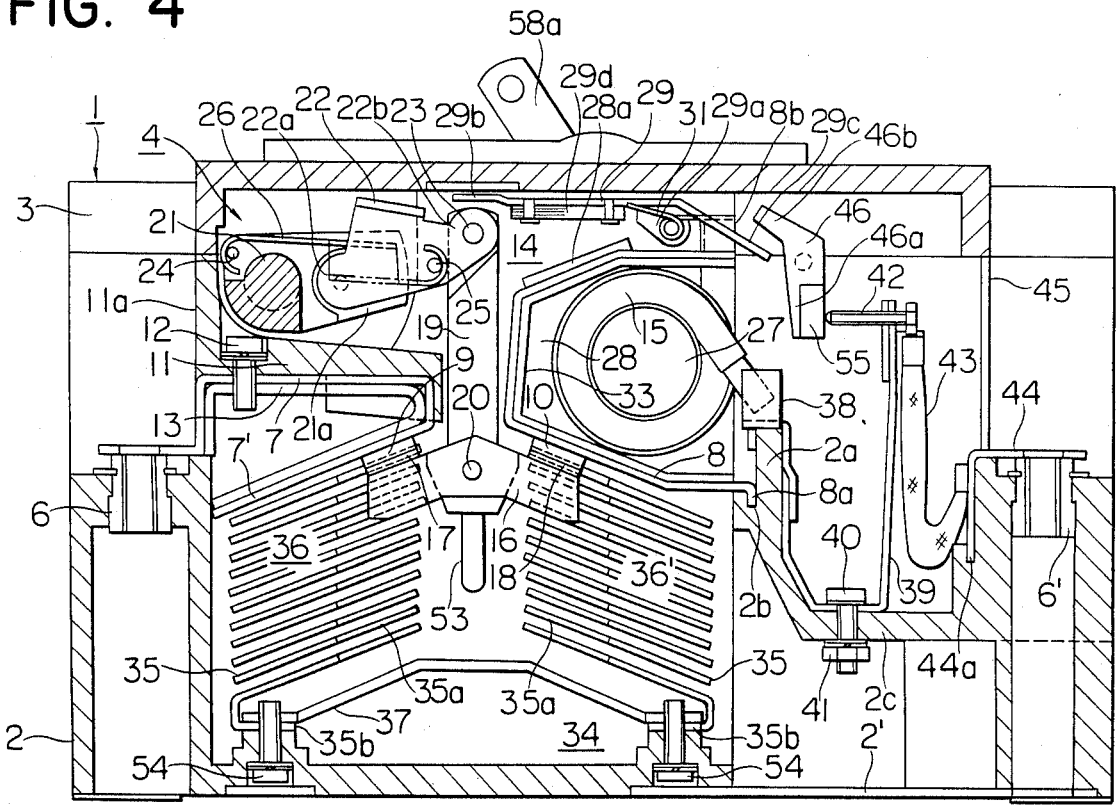
FIGS. 4, 5 and 6 are sectional views of a pole chamber taken along the line IV—IV of FIG. 1, FIG. 4 showing the ON-state, FIG. 5 showing the OFF-state, and FIG. 6 showing the breaking state as a result of a large current.

As shown in FIG. 4, metal terminal pieces 6 and 6' are mounted on terminal shelves at both ends of each pole. A fixed contact device includes a first fixed conductor 7 and a second fixed conductor 8 being provided opposite each other with a space left therebetween, and to the first and second conductor 7 and 8 a first fixed contact 9 and a second fixed contact 10 are respectively attached. One end of the first conductor 7 is led out to the terminal shelf to be connected to the metal terminal piece 6, the other end is bent into a V-shape, and the first contact 9 is set on the bent portion 7' near the point of bending. Also, on the upper portion of the first fixed conductor 7, an L-shaped first fixed conductor cover 11 molded of a formable insulator is fastened by a screw 12. A vertical portion 11*a* of the first conductor cover 11 constitutes one of the end walls in each pole chamber 4. A ferromagnetic body 13 is mounted on the inside face of the first conductor 7 along the configuration thereof.

The second fixed conductor 8 is formed to surround three sides of a winding 15 in an electromagnetic device 14. One end of the second conductor 8 has a bent portion 8*a* which is engaged with a fitting slot 2*b* formed in a partition wall 2*a* of the mold base 2 for accommodating tripping elements, and the other end has a projecting winding connection tab 8*b* which is bent laterally.

A movable contact device includes a movable contact arm 16. First and second movable contacts 17 and 18 are attached to the ends of the contact arm 16 so that they may be respectively associated with the first and the second fixed contacts 9 and 10 and so that they can bridge between the fixed contacts 9 and 10 in closing the circuit and can separate from the fixed contacts 9 and 10 in opening the circuit. As shown in FIGS. 4 and 7, the movable contact arm 16 is, in the center thereof, inserted into a fitting slot 19*a* formed at a lower enlarged portion of a supporting rod 19 made of insulator, and the supporting rod 19 and the contact arm 16 are connected into one body by means of a pin 20. The upper end of the rod 19 has forked arms 19*b* and 19*c*.

Contact cross bar 21 of molded insulator extends through each of the poles from the switch operating mechanism chamber 5, as shown in FIGS. 2 and 4, has arms 21*a* which are integrally molded with the bar 21 and diverge into two plates at each pole. A projection 22*a* which projects from two wing portions at one end of a movable contact link 22 is inserted into and rotatably supported at the end portions of these arms 21*a*. The movable contact link 22 are made of a ferromagnetic substance and are bent into a U-shape. Two wing portion legs 22*b* formed at the other end of the contact link 22 are inserted between the above-mentioned forked arms 19*b* and 19*c* and are integrally connected to them by a pin 23. A toggle spring 26 is held between pins 24 and 25 which are respectively set between the arms 21*a* and between the legs 22*b*. Thus, a dead center link mechanism is formed which applies pressure to the movable contacts 17 and 18 in the closing state in order that they may be brought into contact with the fixed contacts 9 and 10.

Figure 5:
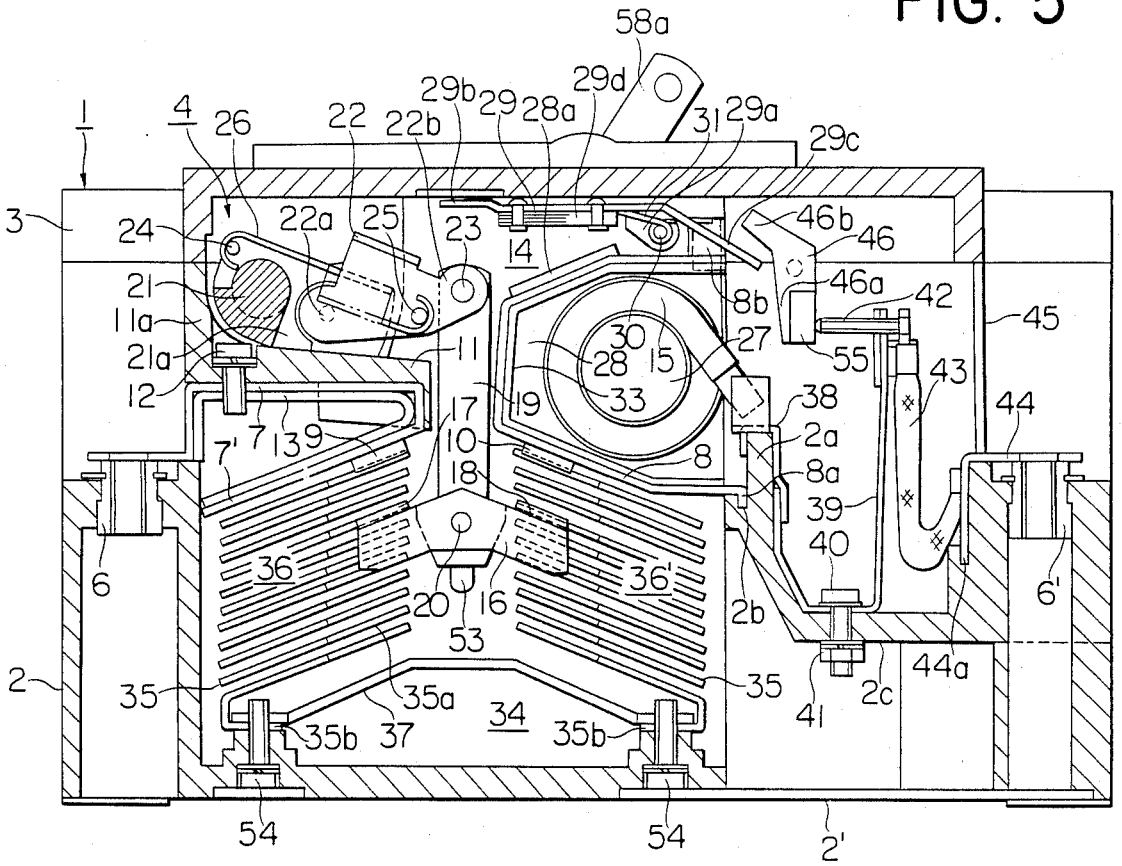
Figure 8:
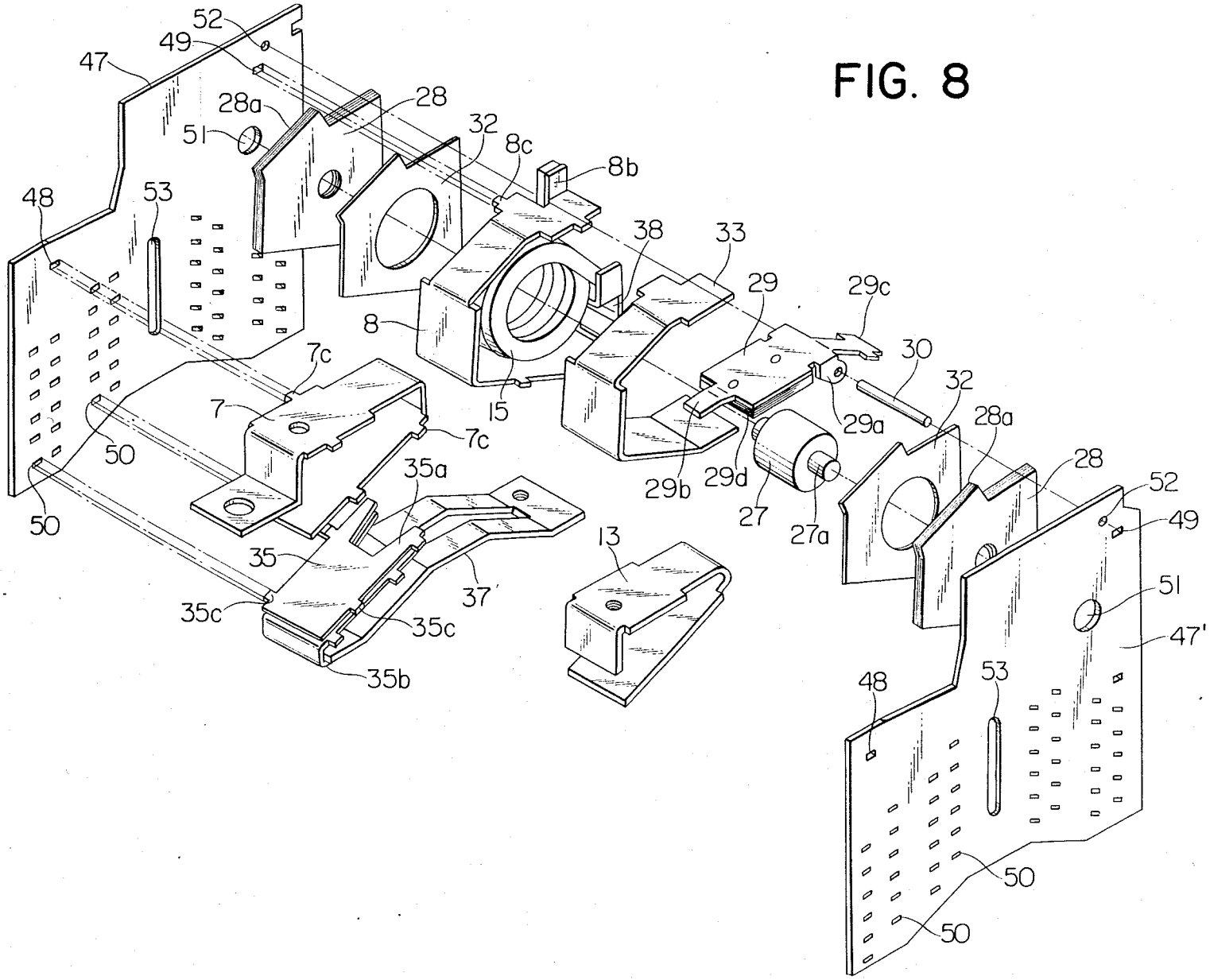
FIG. 8 is an exploded view in perspective of a part of a pole chamber unit comprising main component means supported between a pair of opposed insulating plates.

As shown in FIGS. 4, 5 and 8, the electromagnetic device has yokes 28 made by laminating a plurality of magnetic steel plates on both ends of a cylindrical fixed iron core 27 on to which the winding 15 is wound. Each of these yokes 28, have a projection portion 28*a* formed at a position opposite a movable steel plate 29. The movable steel plate 29 is rotatably supported by a bent lug portions 29*a* by a shaft 30. One end portion 29*b* of the steel plate 29 is opposed to the upper end of the supporting rod 19, and the other end portion 29*c* is opposed to a trip bar 46 which is mentioned hereinafter. Also, and attraction portion 29*d* made from laminated magnetic steel plates is mounted on a portion of the steel plate 29 which is opposite the projection portions 28*a* of the yokes 28. Such a movable steel plate 29 is continually biassed clockwise by means of a return spring 31. Further, insulating plates 32 and 33 are mounted along the insides of both yokes 28 and the second fixed conductor 8 as shown in FIG. 8. The winding 15 is wound so that its ampere turn may be constant in each different rated current, and thereby the ratio of the instantaneously tripping point to each rated current is continually constant. When the movable steel plate 29 is attracted, a first portion 29*c* of the steel plates 29 acts on the trip bar 46 in the tripping mechanism 5B, and a second portion 29*b* pushes the supporting rod 19.

An arc extinguish chamber 34 is provided with arc extinguish devices 36 and 36' on both sides of the movable contacts 17 and 18. The arc extinguish devices 36 and 36' are comprised of a plurality of arc extinguish grids 35 respectively having notches 35*a* on the side of the contact 17 or 18, the grids 35 being arranged in parallel and leaving a insulating space therebetween in the open direction. On the side opposite to the notch 35*a*, the arc extinguish grids 35 which are at the lowest portion of the arc extinguish devices 36 and 36' have bent connecting portions 35*b*. And the arc extinguish device 36 and 36' are connected to each other by an arc discharging plate 37 which bridges between the associated bent connecting portions 35*b*.

One end of the winding 15 is connected to the connecting lug 8*b* of the second fixed conductor 8, and the other end is connected to one end of a winding leadout terminal plate 38 which is arranged to be astride of the upper edge of the partition wall 2*a*. A base portion of a bimetal 39 which is bent into a J-shape as an overcurrent response element is fastened to a base wall 2*c* of a cavity for accommodating the tripping elements by means of a screw 40 and a nut 41. One end of the bimetal 39 is connected to the other end of the terminal plate 38, and to the upper portion of the other end of the bimetal 39 a bimetal adjusting screw 42 is set and one end of a flexible lead wire 43 is connected. The other end of the flexible lead wire 43 is connected to the terminal metal plate 6' through a conductive terminal 44. One end of the mold base 2 is provided with an end plate 45 of the pole chamber 4 which is made of an insulator. The head end of the bimetal adjusting screw 42 is opposite a tongue **46*a* of a trip bar 46 which is molded of insulator. An upper projection lug 46*b* of the trip bar 46 is arranged to associate with a tail portion 29*c* of the movable steel plate 29**.

The fixed means, such as said first fixed conductor 7, the second fixed conductor 8, the electromagnetic device 14 and the arc extinguish devices 36 and 36', are integrally mounted between a pair of insulating plates 47 and 47' in each pole chamber 4. As shown in FIGS. 7 and 8, the insulating plates 47 and 47' are spaced from each other so that their outer faces can be closely inserted between sidewalls of a tunnel-like accommodating slot in each pole chamber 4, the groove being formed by the mold base 2 and the mold cover 3. These insulating plates 47 and 47' have a plurality of perforactions. Projections **7*c*, 8*c* and 35*c* etc. which are integrally formed at both side edges of the first and the second fixed conductors 7 and 8 and the arc extinguish grids 35 are respectively inserted into and caulked to their associated perforations 48, 49, 50 etc. The fixed iron core 27 in the electromagnetic device 14 extends through the winding 15, the insulating plates 32 and the yokes 28, and projecting cylinders 27*a* at its ends are inserted into and caulked to bores 51 in the insulating plates 47 and 47'. The movable steel plate 29 is supported by shaft 30 which is inserted into the lugs 29*a* and bores 52 in the insulating plates 47 and 47'**.

The supporting rod 19 having the movable contact arm 16 which is fitted into the fitting slot **19*a* at the lower portion of the rod is inserted from a space between the insulating plates 47 and 47', and the pin 20 extends between guide slots 53 in the plates 47 and 47' through the movable contact arm 16 and the supporting rod 19, and thereby the arm 16 and the rod 19** are supported so as to be movable in the opening and closing direction.

Upon assembly, it is desirable as mentioned above to set the first and the second fixed conductors 7 and 8, the electromagnetic device 14 and the arc extinguish devices 36 and 36' between a pair of the insulating plates 47 and 47', and to hold the arc discharging plate 37 between the lower edges of the insulating plates 47 and 47' and between the bent connecting portions **35*b* of the lowest arc extinguish grids 35, and to insert a pole chamber unit, to which the winding leadout terminal plate 38, the bimetal 39, the flexible lead wire 43 and the conductive terminal 44 are integrally connected, into the accommodating slot in the pole chamber 4, and then to set the first fixed conductor cover 11 on the first fixed conductor 7, to next insert the one end of the movable contact link 22 between the forked arms 19*b* and 19*c* of the supporting rod 19 to join them with the pin 23, and to set the contact cross bar 21 connected to the movable contact link 22 in the predetermined position, and to screw and fix a screw 54 through the bent connecting portion 35*b* to the tapped bore in the arc discharging plate 37, and further to set the leading plate 38 on the upper edge of the partition wall 2*a*, to attach the bimetal 39 to the base wall 2*c* by means of the screws 40 and 41 and lastly, to fit the end 44*a* of the conductive terminal 44 to a slot in the mold base 2**.

The trip bar 46 extends from the operating mechanism chamber 5 over each of the poles through the vicinity of the joint portion of the mold base 2 and the mold cover 3. The tongue **46*a* which is formed in the trip bar 46 in each pole has an inclined face 55 formed on one side thereof, and the inclined face 55 can be disposed in a suitable position by the operation of adjusting the gap between a bimetal adjusting screw 42 and the tongue 46*a*. That is, because the trip bar 46 is supported so as to be movable in a direction intersecting the poles, the position of the inclined face 55 can be varied by the rated current adjusting mechanism 5C in the operating mechanism 5, and therefore by varying the gap between the inclined faces 55 and their associated bimetal adjusting screws 42** the rated current can be adjusted.

Figure 3:
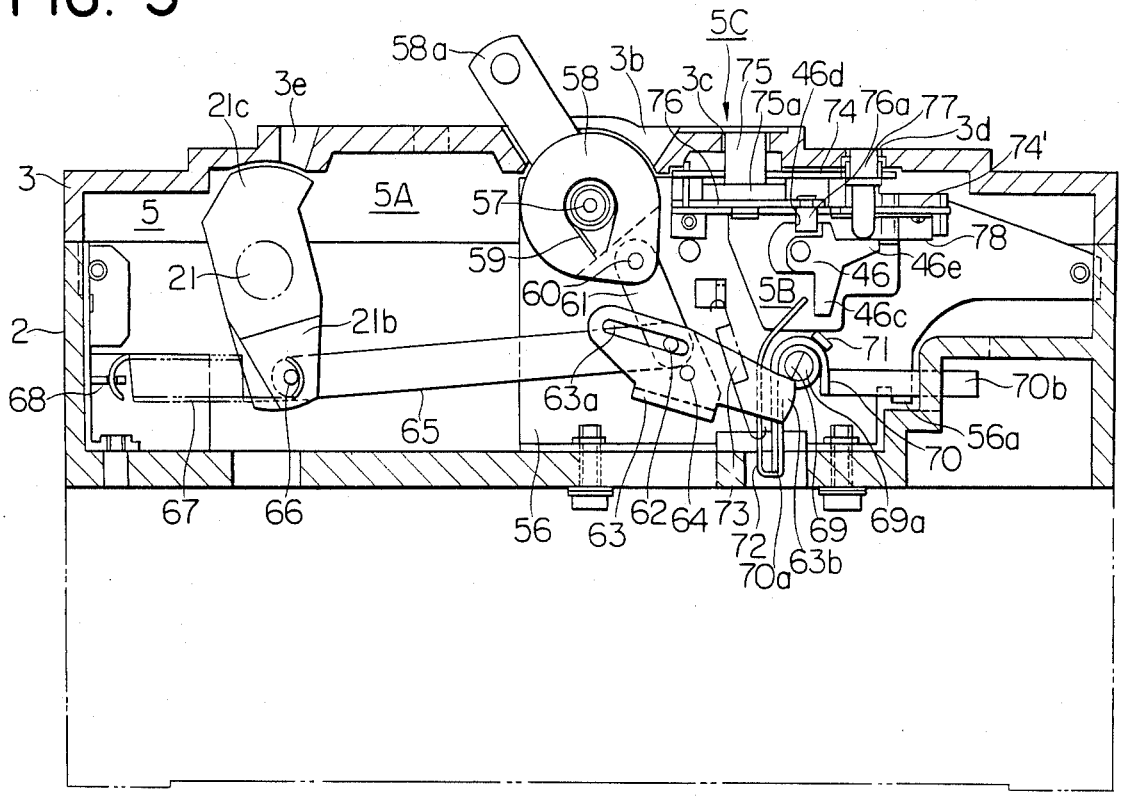
FIG. 3 is a sectional view of a switch operating mechanism chamber taken along the line III—III of FIG. 1.

As shown in FIG. 3, the switch operating mechanism chamber 5 is provided with the switch operating mechanism 5A and the trip mechanism 5B in relation to the contact cross bar 21 and the trip bar 46. The operating mechanism 5A is adapted to be free to trip by the working of the trip mechanism 5B regardless of its position in the process of the closing operation.

The operating mechanism 5A has a handle 58 molded of an insulator which is supported by a pair of fixed frames 56 fixed to the mold base 2 with a handle shaft 57, and an operating lever **58*a* of this handle 58 projects from an operating portion 3*b* in the mold cover 3 so that it can rotate the handle 58. When this operating lever 58*a* of the handle 58 is inclined to the left, the circuit breaker represents the ON-state, and a handle spring 59, which is bridged between the fixed frame 56 and the handle 58, makes the handle 58 usually deflected in the OFF-direction, that is, clockwise. To the handle 58 one end of an operating link 61 is connected by a pin 60, and the other end is slidably connected to a slotted aperture 63*a* in a trip lever 63 by a pin 62. Also, the trip lever 63 is rotatably supported by means of a trip lever shaft 64 fixed on the fixed frame 56. One end of a contact link 65 is connected to the operating link 61 by the pin 62, and the other end is connected to by a pin 66 a cross bar operating arm 21*b* which is integrally molded with the contact cross bar 21. One end of a breaking spring 67 is held on the pin 6, and the other end is held on a spring supporting lug 68 attached to the mold base 2, and therefore this spring 67 biases the cross bar 32** clockwise.

When the trip mechanism 5B is in its normally closed circuit state, a claw **63*b* at one end of the trip lever 63 is engaged with a semicircular notch portion 69*a* of a trip pin 69 which is supported on the fixed frame 56. A trip pin arm 70 has a portion curved along the outer face of the trip pin 69, and is fastened to the trip pin 69 by a screw 71 so that its angle of rotation with the trip pin 69** can be adjusted.

One end of a bimetal 72 for ambient temperature correction is connected to a side portion **70*a* of the trip pin arm 70 and the other end is mounted at a position opposed to a projection 46*c* of the trip bar 46 in the operating mechanism chamber 5. A trip pin return spring 73 is disposed to continually urge the trip pin arm 70 clockwise. The clockwise motion of the arm 70 is limited by the engagement with a projection 56*a* formed in the fixed frame 56, and as a result of this limitation, a stationary position of the arm 70** in a steady state can be determined.

The rated current adjusting mechanism 5C has a rated current adjusting knob 75 of an insulator which is rotatably supported between fitting means 74 and 74' fixed on the fixed frame 56. This knob 75 is adapted so that its head portion is exposed from an aperture in the mold cover 3, and so that its lower end can rotate a working lever 76 with the aid of an eccentric cam 75*a*. A working pin 76*a* which is set in one end of the working lever 76 is engaged with a slotted bore 46*d* in the trip bar 46. When rotating the knob 75 from the outside, the trip bar 46 is axially moved, the position of the inclined face 55 on the tongue 46*a* in each pole chamber 4 is shifted and the gap between the inclined face 55 and the screw 42 is varied, thus enabling the rated current to be adjusted.

As with the rated current adjusting knob 75, a trip button 77 is arranged so that its head portion is exposed from an aperture 3*d* in the mold cover 3, and so that its lower end pushes a projection 46*e* of the trip bar 46 through a U-shaped button return spring 78 which is mounted on the lower side of the fitting means 74'. At the head portion of the contact cross bar 21 at the end opposite to the cross bar operating plate 21*b*, a switch indication plate 21*c* is integrally formed, to indicate the ON-OFF state through an indication window 3*e* in the mold cover 3.

The switching operation of the circuit breaker of the above-mentioned embodiment in accordance with the present invention, is as follows:

The states shown in FIGS. 3 and 4 are an ON-state where the operating lever 58*a* of the handle 58 is inclined to the left. If the operating lever 58*a* is manually moved to the right in order to change from this ON-state to the normal OFF-state, the handle 58 moves the pin 62 to the left along the slotted aperture 63*a* in the trip lever 63 by means of the operation link while keeping the claw 63*b* and the notch portion 69*a* engaged, while at the same time both the contact cross bar 21 is rotated clockwise and the breaking spring 67 is compressed by means of the contact link 65, and a line linking the handle shaft 57 and the pins 60 and 62 shift to an L-shaped over center link state, whereby the handle 58 and the operating link 61 are kept statical. Accordingly, the arm 21*a* of the contact cross bar 21 and the movable contact link 22 are integrally rotated clockwise, and then, the supporting rod 19 and the movable contact arm 16 connected to the rod 19 are shifted. Thus, the pin 20 is slid down along the guide slots 53, and then the first and second movable contacts 17 and 18 are separated from the first and second fixed contacts 9 and 10, whereby the movable contact arm 16 becomes an OFF-state as shown in FIG. 5.

When manually moving the operating lever 58*a* to the left from the OFF-state, the pin 62 is moved to the right along the slotted aperture 63*a* by means of the operating link 61, and the contact cross bar 21 is rotated counterclockwise by the contact link 65, and then the arms 21*a* and the movable contact link 22 are integrally rotated counterclockwise, therefore pulling the movable contact arm 16 up by means of the supporting rod 19 to become an ON-state in that the first and second movable contacts 17 and 18 are pressed upon the first and second fixed contacts 9 and 10.

The following detailed description deals with the case of automatic breaking by the operation of the tripping device when normal overcurrent flows in the ON-state. The bending of the bimetal 39 causes the adjusting screw 42 to press the inclined face 55 of the tongue 46*a*, so that the trip bar 46 is rotated clockwise. At this moment, the bimetal 72, the trip pin arm 70 and the trip pin 69 are integrally rotated counterclockwise by means of the projection 46*c* of the trip bar 46 in the operating mechanism chamber 5, causing the engagment of the notch portion 69*a* and the claw 63*b* to be released, whereby the trip lever 63 is rotated counterclockwise. Further, the force of the breaking spring 67 makes the pin 63 move to the left along the slotted aperture 63*a* with the aid of the contact link 65, and this results in the spring 67 being compressed and at the same time the contact cross bar 21 being rotated clockwise, and finally the first and the second movable contacts 17 and 18 are separated from the fixed contacts 9 and 10 to cut off the current.

At this time, as the handle 58 is simultaneously rotated clockwise by means of the handle spring 59, the operating link 61, the trip lever 63 and the contact link 65 are pulled up. Therefore, passing through the automatical breaking state, it becomes an OFF-state so that the claw 63*b* is engaged with the notch portion 69*a*.

Figure 6:
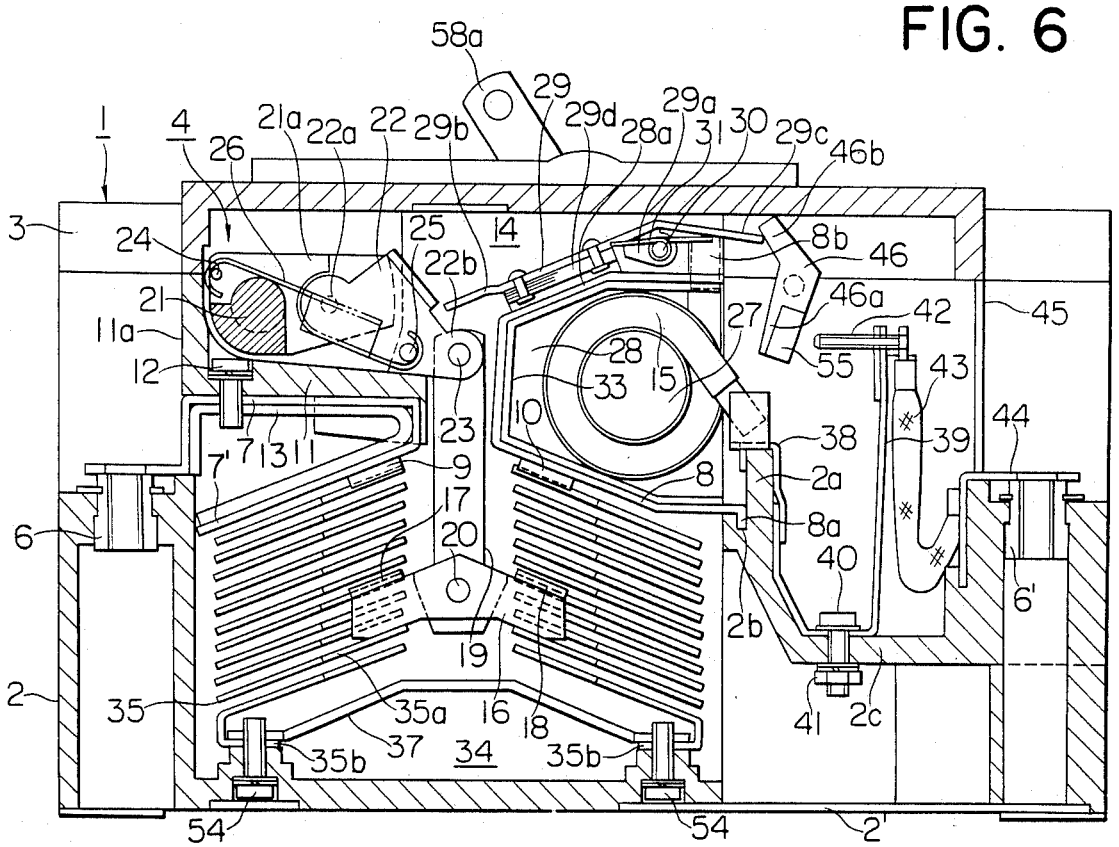

With reference to cases where the overcurrent is above 8 to 13 times as great as the rated current, that is, above the determined current for the instantaneously trip point, first the electromagnetic device 14 is excited by that overcurrent, whereby the initial attracting action of the attraction portion 29*d* to the projection portions 28*a* of the yokes 28 makes one end 29*b* of the movable steel plate 29 hit the upper end of the supporting rod 19. And so, keeping the contact cross bar 21 in the closed circuit state, the movable contact link 22 is rotated clockwise on the shaft 22*a* against the toggle spring 26, and then the movable contacts 17 and 18 begin to separate at high speed from the fixed contacts 9 and 10, and the arc voltage consequently increases creating a sufficient initial current-limiting effect. While the movable steel plate 29 is completely attracted to the yokes 28, the movable contact link 22 is rotated until the working line of the toggle spring 26 approaches the shaft 22*a*, causing the working force of the toggle spring 26 to the movable contact link 22 to decrease greatly. When a large current such as a short-circuit current flows in such a state, the electromagnetic repulsive force which arises between the movable contacts 17, 18 and the fixed contacts 9, 10, or the attracting action of the movable contact link 22 by the first fixed conductor 7 is added, whereby the movable contact link 22 is rotated in the direction where the first and the second movable contacts 17 and 18 are opened, and then the working line of the toggle spring 26 goes beyond the shaft 22*a* to the opposite side. Accordingly, as its working force reverses, the movable contact link 22 is rapidly rotated clockwise, and the break open circuit state shown in FIG. 6 is reached in which he opening distance is larger than the normal opening distance shown in FIG. 5. The larger the current such as a short-circuit current is, the more the electromagnetic repulsive force between the movable and the fixed contacts, or the attraction force of the magnetic substance 13 to the movable contact link 22 increases, whereby the reversal of the working force of this toggle spring 26 is accelerated. Also, the attracting action of the movable contact link 22 through the first fixed conductor 7 is strengthened by means of the magnetic substance 13. Further, the magnetic substance 13 reinforces the first fixed conductor 7.

On the other hand, when one end of the movable steel plate 29 is attracted by the yokes 28, the other end 29*c* hits the projection 46*b* of the trip bar 46 to rotate the trip bar 46 clockwise, and the engagement of the trip pin 69 and the trip lever 63 is released, whereby through the aid of the contact link 65 the contact cross bar 21 is rotated clockwise by the working force of the breaking spring 67 to move the contact cross bar 21 to the closed circuit position. Upon this movement of the contact cross bar 21, the shaft 22*a* goes beyond the working line of the toggle spring 26 to the opposite side, this spring keeping the movable contact link 22 in the break open circuit position, and the working force of the spring returning to normal resulting in the open circuit state shown in FIG. 5.

In this preferred embodiment of the present invention, automatic breaking can be safely attained when in an overcurrent range which is just a little over the rated current for instantaneous tripping where the electromagnetic repulsive force between the movable and the fixed contacts, or the attraction force of the movable contact link 22 to the magnetic substance 13 can not be fully exhibited even if it is impossible for one end 29*b* of the movable steel plate 29 to be attracted by the yokes 28 to push the supporting rod 19 down in the opening direction, so that the position of the movable contact link 22 reverses the working force of the toggle spring 26, because the other end 29*c* of the movable steel plate 29 turns the trip bar 46 to collapse the switch operating mechanism, whereby the contact cross bar 21 is rotated to continuously break the circuit. Further, the movable steel plate 29 may have such a stroke that, when the movable steel plate 29 is attracted by the yoke 28, the contact cross bar 21 is kept in the closed-circuit position and one end 29*b* of the movable steel plate 29 reverses the working force of the toggle spring 26, the steel plate 29 pushing the supporting rod 19 down until the movable contact link 22 can be rotated by the force within toggle spring 26.

Figure 9:
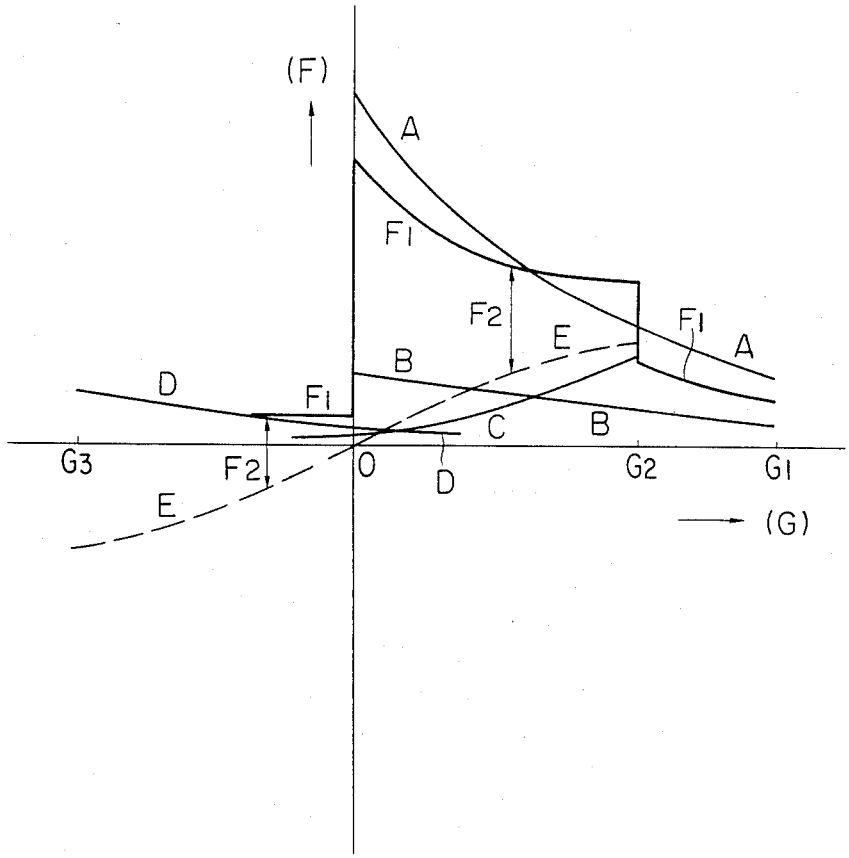
FIG. 9 is a diagram showing the mutual relation among the attractive force of an electromagnet which arises from a current for starting the opening of the movable contacts, the electromagnetic repulsive force between a fixed contact and the movable contacts, the attractive force of a movable contact link, and the restoring or opening force arising in a movable contact lever from a dead center link mechanism, within the circuit breaker of the invention.

Referring to FIG. 9, the relation between the working force of each element when automatically breaking a relatively large current which is over the instantaneous tripping setting current is explained as follows. FIG. 9 is a diagram showing the mutual relationship among the attraction force of the electromagnetic device 14 which arises out of the current for starting the opening of the movable contacts 17 and 18, the electromagnetic repulsive force between the fixed contacts 9, 10 and the movable contacts 17, 18, the attraction force of the movable contact link 22, and the return or opening force generated in the movable contact arm 16 from the dead center link mechanism. As the short-circuit current varies with the passage of time in not only alternating current but also direct current, real analysis must contain a factor of time, but for convenience, the value of the current is constant.

In FIG. 9, the abscissa shows the position of the supporting rod 19, the movable contact 17 and 18, and the movable contact arm 16, and the ordinate shows the force which each of the elements generate, and the return or opening force of the movable contacts 17 and 18. The point of origin O is dead center of the dead center link mechanism, and the position $G_1$ is the starting position of the movable steel plate 29, and the positions $G_2$ and $G_3$ are the starting position and the maximum opened position respectively. The curved line A shows the attraction characteristic of the electromagnetic device 14, which shows that the attraction force increases with the movement of the movable steel plate 29 from the position $G_1$ to the position O. The curved line B shows the repulsive force of the return spring 31, and the difference between the line A and the line B indicates the working force of the electromagnetic device 14. The curved line C shows the electromagnetic repulsive force generated between the fixed and the movable contacts, which is maxmal at the position $G_2$ and decreases with the separation. The curved line D shows that the force which attracts the movable contact link 22 by the current passing through the fixed contacts 9 and 10 increases with approaching the position $G_3$. The curved line E is the force generated by the dead center link mechanism, this line showing that the force is a positive return force at the right of the position O and that the force is a negative opening force at the left. FIG. 9 shows the example where the position O which is the dead center matches the last attraction position of the movable steel plate 29, but it is a matter of course that there may be a little difference between the positions.

In such a relation as in FIG. 9, the working force F acting on the movable contact arm 16 and the supporting rod 19 is represented by the following equation;

$$F_1 = A - B + C + D$$

and, the difference between the action force $F_1$ and the curved line E is the dissociating force $F_2$ of the movable contacts 17 and 18. Accordingly, it can be understood from FIG. 9 that the attracting force (A−B) of the movable steel plate 29 works only within the range of $E>0$, that is, between the position O and the position $G_2$, and generated a strong opening force in cooperation with the electromagnetic repulsive force C. Between the position O and the position $G_3$ the movable contacts 17 and 18 receive the force of $E<0$, whereby they can automatically open themselves, and additionally increasing the attracting force D of the movable contact link 22 can generate sufficient opening force even if the electromagnetic repulsive force C attenuates. Thus, in accordance with the present invention, it is possible that the forces generated in each portion can cooperate to develop the preferred opening action.

In the above-mentioned embodiment, although various rated current are applied to the circuit breaker, the circuit breaker can be adapted to equalize the ratio of the instantaneous tripping point to each rated current, because the winding 15 is wound so that its ampere turns may be constant for each rated current. Accordingly, the movable contacts 17 and 18 can be opened by a current lower than the smaller rated current, and, since the inner resistance becomes larger, a greater current-limiting effect can be attained the smaller the rated current is. Further, it is possible that the magnetic flux leakage from the electromagnetic device 14 acts on the arc which arises between the second fixed contact 10 and the second movable contact 18 in breaking the circuit, causing the arc to be led into the arc extinguish chamber 34 in accordance with Fleming's left-hand rule, and that the magnetic flux acts on the movable contact arm 16 to strengthen the electromagnetic repulsive force.

Figure 10:
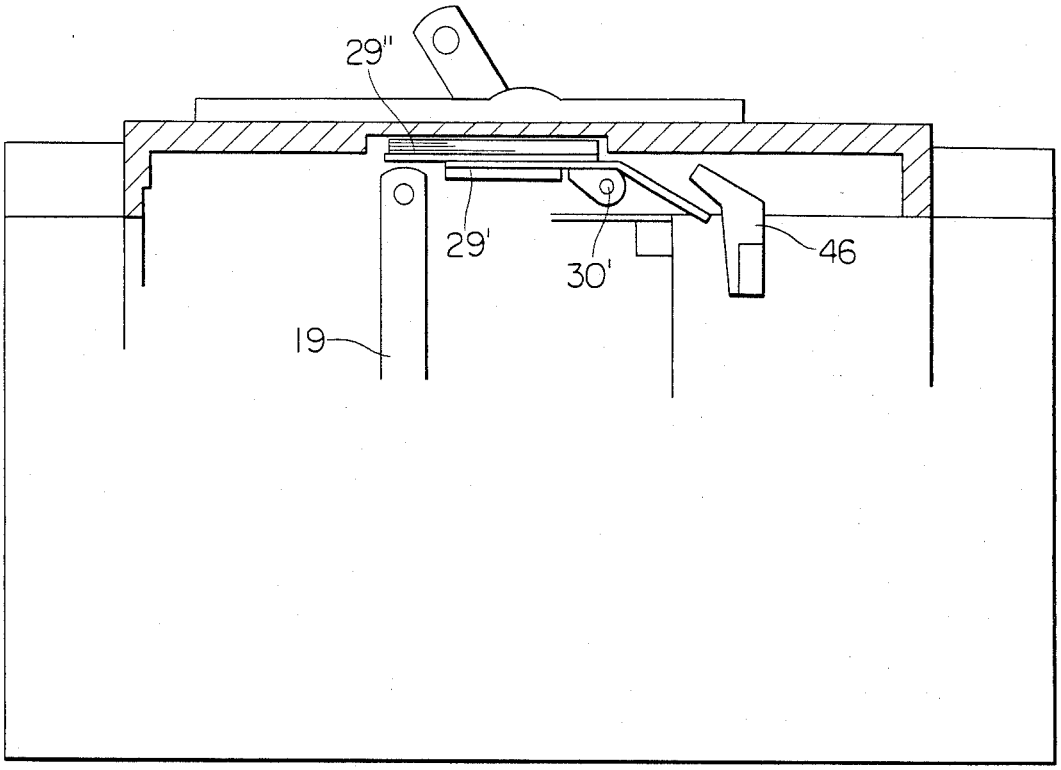
FIGS. 10 and 11 show another embodiment of the invention in which an electromagnetic device is modified, FIG. 10 being a sectional view of modified main parts in a pole chamber, and FIG. 11 being an exploded view in perspective of the modified main parts of FIG. 10.
Figure 11:
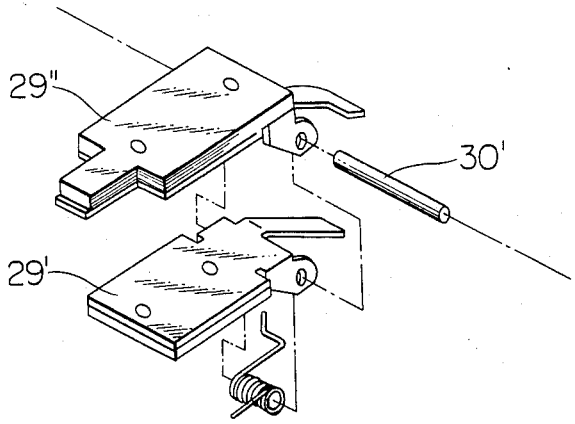

The movable portion which is opposite to a set of fixed core means 15, 27 and 28 may be separated as shown in FIGS. 10 and 11 into a first movable steel plate 29' which has a first portion for acting on the trip bar 46 when being attracted, and a second movable steel plate 29″ which has a second portion for hitting the supporting rod 19. These first and second movable steel plates 29′ and 29″ are supported by a common shaft 30′ so that the second steel plate 29″ can be attracted to the fixed core means 15, 27 and 28 so as to overlap the first steel plate 29′ from above. Another modification is to completely divide the first steel plate 29′ and the second steel plate 29″ and to support each of them on separate shafts.

Obviously many modifications and variations of the present invention are possible in light of the above teachings. It is therefore to be understood that within the scope of the appended claims the invention may be practiced in ways other than as specifically described.

What is claimed is:

1. A circuit breaker comprising:

first and second fixed contact devices disposed at each pole and insulated from each other, said first and said second fixed contact devices having first and second fixed contacts respectively;

a movable contact arm having first and second movable contacts which are respectively associated with said first and said second fixed contacts, said movable contact arm bridging between said first and said second fixed contacts in a closed circuit state to flow current in an opposite direction to the current which flows near said first and said second fixed contacts;

a supporting rod having said movable contact arm at one end thereof, and being supported so that it can be guided to open or close a circuit;

a cross bar having arms insulated at every pole, said cross bar controlled to be capable of opening-closing the circuit and tripping by means of a trip-free mechanism;

a movable contact link whose one end is rotatably supported on said arms and whose other end is rotatably connected to the other end of said supporting rod;

a toggle spring supported so as to constitute a dead center link mechanism between said arms and said movable contact link so that said movable contacts can press on said fixed contacts in a closed circuit state;

a trip bar being common to all poles, said trip bar making a latch mechanism in said trip-free mechanism do the tripping action; and a set of electromagnetic devices in which a winding passing the current of a main circuit is wound, wherein a movable portion in said electromagnetic device has a first portion which engages a part of said trip bar to release a trip mechanism, and second portion which engages said supporting rod to open said movable contact arm to the vicinity of dead center, and wherein said movable contact arm has a position of stop of opening said contacts at which the force of said toggle spring reverses over said dead center, and wherein, during a short-circuit, an electromagnetic repulsive force generated between said fixed and said movable contacts and an attaction force of said electromagnetic device directly open said movable contact arm to said position of stop of opening against the contacting force of said toggle spring to break the circuit.

2. A circuit breaker as claimed in claim 1 wherein said electromagnetic device is separated into a first movable steel plate having said first portion for working said trip mechanism, and a second movable steel plate having said second portion for engaging said supporting rod, said first and said second movable steel plates being arranged in relation to said fixed core means so that said first movable steel plate is independently attracted, but said second movable steel plate is attracted along with said first movable steel plate.

3. A circuit breaker as claimed in claim 1 wherein a breaking spring is held by said cross bar, said breaking spring having sufficient force to return automatically said movable contact link and said toggle spring which are in reversed state by rotating said cross bar through the action of said breaking spring after a short-circuit breaking, to a normal OFF-state.

4. A circuit breaker as claimed in claim 1 wherein the diameter of said winding in said electromagnetic device is adapted to correspond to the rated current of the circuit breaker, causing the exciting ampere turn to be constant at a current based on the ratio to the rated current in spite of the size of the rated current, said thereby ratio of the setting current to the rated current for working said electromagnetic device and said trip bar being constant regardless of the size of the rated current.

5. A circuit breaker as claimed in claim 1 wherein said first fixed contact device consists of a flat conductor in a bent shape, and wherein a forromagnetic substance is mounted on the inside of said bent portion, and further wherein said movable contact link is made of a ferromagnetic substance and is disposed in the vicinity of the outside of said bent portion, said movable contact link being attracted towards said conductor by a large current such as a short-circuit current, causing said movable contacts which are opened by the electromagnetic repulsive force and said electromagnetic device to be further assisted towards the opening direction.

6. A circuit breaker as claimed in claim 1 or 3 wherein said electromagnetic device is in the vicinity of said second fixed contact, magnetic flux leakage from said electromagnetic device acting on an arc which arises between said second fixed contact and said second movable contact to lead the arc by Fleming's left-hand rule into an arc extinguish chamber which is opposed to said second fixed contact and said second movable contact.

* * * * *